US007604547B2

(12) United States Patent
Rushe

(10) Patent No.: US 7,604,547 B2
(45) Date of Patent: Oct. 20, 2009

(54) GOLF TRAINING DEVICE

(75) Inventor: Eanna Rushe, Greenwich, CT (US)

(73) Assignee: BioSport Technologies LLC, Greenwich, CT (US)

( * ) Notice: Subject to any disclaimer, the term of this patent is extended or adjusted under 35 U.S.C. 154(b) by 26 days.

(21) Appl. No.: 11/810,963

(22) Filed: Jun. 6, 2007

(65) Prior Publication Data

US 2008/0064520 A1 Mar. 13, 2008

Related U.S. Application Data

(60) Provisional application No. 60/811,203, filed on Jun. 6, 2006.

(51) Int. Cl.
*A63B 69/36* (2006.01)

(52) U.S. Cl. ..... 473/277; 473/271

(58) Field of Classification Search ..... 473/207, 473/215, 217, 218, 219, 227, 266, 270, 271–277
See application file for complete search history.

(56) References Cited

U.S. PATENT DOCUMENTS

| | | | | |
|---|---|---|---|---|
| 3,079,152 | A | 2/1963 | Cushing | |
| 3,138,388 | A * | 6/1964 | Herold | 473/276 |
| 3,215,438 | A | 11/1965 | Sheldon et al. | |
| 3,698,721 | A | 10/1972 | Stewart | |
| 3,937,473 | A | 2/1976 | Blasi | |
| 5,197,739 | A | 3/1993 | Johnson, III | |
| 5,221,089 | A | 6/1993 | Barrett | |
| 5,288,074 | A * | 2/1994 | Scheurer | 473/277 |
| 5,358,250 | A | 10/1994 | Spencer | |
| 5,456,470 | A | 10/1995 | Scheurer | |
| 5,762,565 | A | 6/1998 | Milam et al. | |
| 5,830,079 | A * | 11/1998 | Hudson | 473/272 |
| 5,916,037 | A * | 6/1999 | Hill | 473/277 |
| 6,093,111 | A | 7/2000 | Senn | |
| 6,497,627 | B2 | 12/2002 | Collins | |
| 6,551,196 | B1 | 4/2003 | Kossnar et al. | |
| 6,575,844 | B1 | 6/2003 | Gray | |
| 6,843,730 | B1 * | 1/2005 | Bellagamba | 473/216 |
| 6,988,957 | B2 * | 1/2006 | Bender | 473/266 |

OTHER PUBLICATIONS www.thejournalnews.com, Suburban Gold, Sep. 2003, Eanne Rushe: Biomechanics expert.

* cited by examiner

*Primary Examiner*—Nini Legesse
(74) *Attorney, Agent, or Firm*—Lerner, David, Littenberg, Krumholz & Mentlik, LLP

(57) ABSTRACT

A golf training device having a foot plate, an upright support extending from the foot plate, and a brace associated with the upright support, wherein a golfer may stand upon the foot plate with his buttocks against the brace to provide visual and tactical indication of a departure from the brace during the golfer's swing. In some embodiments of the training device, the brace may be resilient and/or the upright support may rotate. In such cases, the device may include a measurement device to measure the movement of the brace during the golfer's swing. The training device may also include an outrigger with elastic cord for attachment to a golfer to correct a "sway" or "slide" condition.

18 Claims, 5 Drawing Sheets

GOLF TRAINING DEVICE

CROSS REFERENCE TO RELATED APPLICATIONS

This application claims the benefit of U.S. Provisional Application No. 60/811,203, filed Jun. 6, 2006, which is hereby incorporated by reference.

BACKGROUND OF THE INVENTION

The present invention relates generally to golf equipment, and in particular, to a golf practice apparatus for directing a golfer's body during their swing.

Golfers are constantly seeking to improve their swing techniques in order to maximize their accuracy, consistency, and distance. However, one common mistake that golfers often commit is the unnecessary thrust of their center of mass forward toward a target line as the golfer transitions from the backswing, which is the initial movement drawing the club back or away from the target, into the down swing, which is the power portion of the swing where the club is brought swiftly toward the target, i.e., golf ball. This phenomena, often referred to as hip thrust or early extension, can be visualized as the pelvis of the golfer being shifted toward the target line, with the weight of the golfer moving onto his toes from his heels. At the same time the golfer lifts or extends his spine as the golfer approaches impact with the golf ball. This inefficient motion dramatically reduces the chances for the golfer to strike the ball at a consistent rate, force, and angle. In contrast, during a correct swing by more efficient golfers, their center of mass and posture remain stable.

Many devices and apparatuses have been devised to improve a golfer's swing. Unfortunately, most of these devices concentrate on the golfer's pivot and hip rotation during the swing. A typical device may comprise a hip belt or board that the golfer places against their hips. The typical belt or board is a stationary object that hinders the golfer's normal motion. Such conventional devices are limited in that they are designed to treat the golf swing as a two-dimensional function by concentrating on the weight shift of the golfer from his back leg to his front leg and the rotation his hips. However, golf swings are based on a three-dimensional motion where there is not only a translation of weight from the back leg to the front leg together with rotation of the hips and trunk, but also slight movement between the heels of the golfer and the balls of the feet of the golfer. Also, as a golfer rotates into the back swing, the pelvis of the golfer naturally rotates. Rotation of the pelvis may be as high as 45 degrees in some golfers. If a golfer is forced to position their hips against a fixed and rigid board, as in the case with many conventional training devices, the golfer's natural rotational ability is inhibited.

When the efficient golfer transitions into the forward swing, he very often "sits-down" or "squats" slightly as has been described by many leading golf instructors and can be seen on video analysis of efficient golf swings. The "sitting-down" action is an athletic move that promotes lateral movement of the center of mass of the golfer along the target line of his swing. This movement aids in increasing hip speed, which is subsequently translated to the swing of the golf club. If a stationary object is placed against the golfer, and particularly the rear of the golfer, as with many conventional devices, this athletic action is inhibited thereby reducing the efficiency of the swing.

The present invention is designed to not only provide a measuring stick or fixation point for a golfer's center of mass during his backswing and forward transition, but also to allow the golfer to slightly "squat" or "sit-down" as is common in a high-efficiency golf swing.

Two other problems that golfers often encounter stem from excessive lateral movement of their hips or pelvis. This condition is referred to as "sway" when movement is away from the target on the backswing and is referred to as "slide" when movement is toward the target on the downswing. When the hips and pelvis move excessively, the golfer cannot consistently strike the golf ball and tends to have inconsistent results. Meanwhile, lateral movement of the efficient golfer remains relatively calm during backswing and downswing transition. The present invention includes mechanisms to assist with transitioning a golfer with excessive "sway" or "slide" to one with a more efficient golf swing.

SUMMARY OF THE INVENTION

The present invention overcomes the shortcomings of the prior art by providing, in various embodiments, golf training devices that permit instruction or correction of conditions not previously considered, either alone or in combination with other known conditions.

Accordingly, in one aspect of the invention, a golf training device may comprise a foot plate, a shaft extending upward from the foot plate, and an arm extending outward from the shaft to an end. If so configured, a golfer may stand upon the foot plate with his backside against the arm end so as to provide visual and tactical indication of a departure from the arm end during the golfer's swing.

The golf training device may further comprise a pad situated at the arm end.

The shaft of the golf training device may further comprise a fixed shaft and an adjustable shaft. The adjustable shaft may be adapted to move relative to the fixed shaft to adjust the distance between the arm and the foot plate.

The arm of the golf training device may further comprise a compression mechanism adapted to compress and permit the arm end to move toward the shaft upon the occurrence of a sufficient force therein. The force required to compress the compression mechanism may be adjustable. The compression mechanism may further comprise a measurement device adapted to measure the distance the compression device compresses during the swing of a golfer.

The golf training device may further comprise a hinge mechanism permitting the shaft to rotate relative to the foot plate. A tension member may be positioned between the foot plate and the shaft. The tension member may restrain rotation of the shaft relative to the foot plate. An angle measuring apparatus may be adapted to measure the relative angle of the shaft relative to the foot plate. The measuring apparatus may further comprise a digital read out. The angle measuring apparatus may communicate with an electronic device. The golf training device may further comprise a sound generating mechanism adapted to communicate a sound in response to angles measured by the angle measuring apparatus. The sound may be generated by a measurement within a certain range.

The golf training device may further comprise a pivot mechanism permitting the shaft to pivot relative to the foot plate.

The golf training device may further comprise an outrigger attached to the device and an elastic cord attached to the outrigger, wherein the elastic cord may be further attached to a golfer. The elastic cord may be attached to a golfer on the side of his downswing to correct a slide condition. The elastic cord may be attached to a golfer on the side of his backswing to correct a sway condition.

The golf training device may further comprise at least one wheel adapted to permit transport of the training device.

The foot plate of the golf training device may be formed from two regions, at least one of the regions having a weight measurement capability.

In accordance with another aspect of the invention, a golf training device may be adapted to assist with golfer "slide," "sway," and "squat," with the device comprising a foot plate upon which a golfer desirous of training may stand, an upright support extending from the foot plate, the upright support adapted to rotate relative to the foot plate, a brace associated with the upright support, the brace adapted to partially support the weight of a golfer leaning against the brace, an outrigger associated with the foot plate, and an elastic cord extending from the outrigger to an end adapted to attach to a golfer. If so configured, the brace may be used to identify the degree in which a golfer "squats" or "sits-down" and the outrigger and elastic cord may be positioned to prevent "slide" or "sway."

The outrigger may be positioned on the side of the golfer toward which the golfer slides to correct a slide condition and the side in which the golfer sways to correct a sway condition.

In accordance with still further aspects of the present invention, namely a method of golf training, the method may comprise the steps of positioning a golfer with his buttocks against a resilient object, identifying the degree and direction in which the resilient object moves during the golfer's swing, identifying a most-efficient degree and direction of movement for the particular golfer during the golfer's swing, and providing instruction to the golfer to repeat the preferred direction and degree of movement during his swing.

The method may further comprise identifying if the golfer has a "slide" or "sway" condition during the golfer's swing and providing a force upon the golfer in the direction of the "slide" or "sway" condition during the golfer's swing by attaching an elastic cord to the golfer and an outrigger associated with the resilient object.

The level of force applied in the method may be dependent on the golfer's weight and the severity of the "slide" or "sway."

DETAILED DESCRIPTION

In the following description of the preferred embodiments of the present invention, reference is made to the accompanying drawings which form a part hereof, and in which are shown by way of illustration, specific embodiments by which the invention may be practiced. It is to be understood that other embodiments may be utilized and structural changes may be made without departing from the scope of the present invention. It is also to be understood that specific components or features, although shown in one embodiment, may be provided equally effectively with the features of other embodiments.

Figure 1:
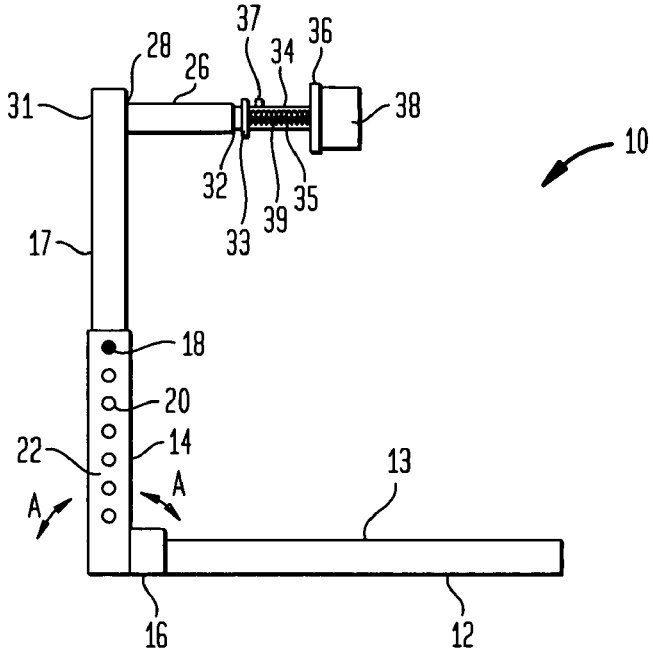
FIG. 1 is a side view of an embodiment of the present invention.
Figure 2:
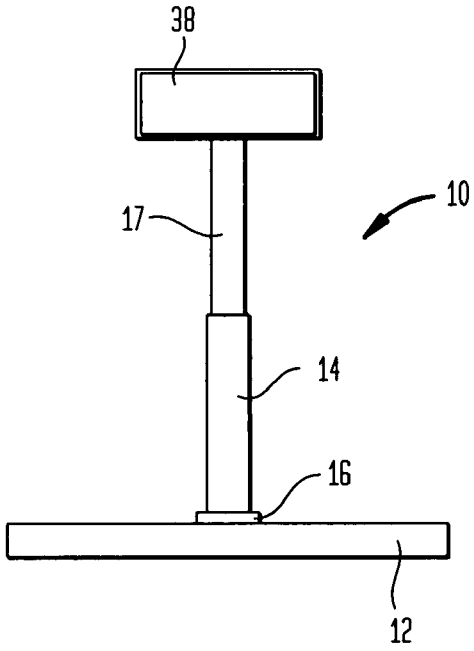
FIG. 2 is a front view of the embodiment shown in FIG. 1.

Referring to FIG. 1, a side view of one embodiment of the present invention, and FIG. 2, a front view thereof, a golf training device 10 may include a foot plate 12 extending outwardly from a fixed shaft 14. The foot plate 12 may be designed such that a golfer may stand on the foot plate in preparation of performing a golf swing. The foot plate 12 is preferably made from a flexible plastic material or lightweight metal with rubber upper surface 13. The flexibility of the foot plate 12 not only allows the golfer to achieve a comfortable standing position on the foot plate, but also enables the foot plate to conform to the ground on which the foot plate is placed. Additionally, the foot plate 12 may be essentially flat, as shown, or shaped to other configurations.

The foot plate 12 may be hingedly connected such as by hinge 16 to an upright support, such as fixed shaft 14. In use, it is preferred in certain embodiments that the hinge 16 be fixed in position such that the fixed shaft 14 extends generally perpendicular to the foot plate 12. Notwithstanding, the hinge 16 is also preferably adjustable such that the fixed shaft 14 may be rotated toward and/or away from the foot plate 12, along arc 'A,' for transport or storage of the training device 10. Such hinges 16 and arrangements therefor are well known in the art.

Fixed shaft 14 is preferably a tubular shaft, although not necessarily cylindrical, and typically constructed from a plastic or lightweight metal. Fixed shaft 14 is preferably telescopically connected to an adjustable shaft 17 in a manner known to those in the art such that the adjustable shaft 17 may move vertically with regard to the fixed shaft 14, preferably, and as shown in FIG. 1, within the fixed shaft.

The adjustable shaft 17 is similarly constructed as fixed shaft 14 but may include a spring-loaded projection 18 that extends outwardly therefrom. The projection 18 may be provided to communicate with apertures 20 extending through an exterior surface 22 of fixed shaft 14 to an interior surface of the fixed shaft. By enabling the projection 18 of the adjustable shaft 17 to mate with apertures 20 of the fixed shaft 14, the adjustable shaft may be locked at varying positions relative to the fixed shaft, depending on which aperture the projection is associated with at the time. This allows adjustment of the total length of the fixed shaft 14 and adjustable shaft 17. Such length-altering arrangements are well known in the industry, and often include a spring-loaded projection with a rounded head to facilitate insertion into the respective aperture, such as those described in latter sections of this description with regard to the outriggers found in certain embodiments.

As shown in FIG. 1, a brace, here shown in the form of an arm 26 and associated components may extend outwardly from the adjustable shaft 17 in a generally perpendicular direction, although a completely perpendicular relation is not required. The arm 26 may be fixed to the adjustable shaft 17 as for instance by welding a first end 28 of the arm to an exterior surface 30 of the adjustable shaft 17 or by integrally forming the two components. Preferably, the arm 26 is attached to the adjustable shaft 17 at a distal end 31 to space the arm above the foot plate 12. It will also be appreciated that the fixed shaft 14, adjustable shaft 17, and arm 26 may be formed as a single component.

The arm 26 may be constructed of similar materials as fixed shaft 14 and adjustable shaft 17, such as metal or plastic, and may also be of a tubular configuration.

Disposed at the second end 32 of the arm 26 may be a compression mechanism 34. The compression mechanism 34 may include a gas spring device 35 (a cut-away view of which is shown in FIG. 1) that is capable of resisting a specific amount of force without compressing. When the specific force is exceeded, however, the compression mechanism 34 is compressed such that the compression mechanism 34 moves generally toward the adjustable shaft 17.

Attached to the opposite end of the compression mechanism 34 from the second end 32 of the arm 26 may be a plate 36 having a pad 38 mounted thereon. The plate 36 provides a rigid support for the pad 38 as well as a mounting structure between the pad 38 and compression mechanism 34. It will be appreciated that the pad 38, plate 36, and compression mechanism 34, if provided, may form portions of the brace.

In a method of use, the golfer positions his feet on the foot plate 12 and his buttocks (which herein refers to either the actual buttocks or general backside) against the pad 38 such that the golfer is facing away from the pad. In this regard, it will be appreciated that the adjustable shaft 17 may be adjusted within the fixed shaft 14 such that the pad 38 is at the appropriate height for a given golfer, i.e. at the level of his buttocks. It is preferred that the training devices of this invention include an adjustment range sufficient for the vast majority of golfers. However, the training device may also be configured for various size ranges, for example a small device serving those from approximately 4'-6" tall to 5'-6" tall, a medium device serving those approximately 5'-0" tall to 6'-0" tall, and a large device serving those over approximately 6'-0" tall, assuming an adjustment range of approximately 1'-0" for each. Of course, other adjustment ranges are contemplated, such as that which would be sufficient to provide two devices covering the range of anticipated golfer heights.

Once positioned with his buttocks against the pad 38, the golfer should also provide a suitable force against the pad 38 with his buttocks. The compression mechanism 34 applies a resultant force (equal and opposite) against the golfer thereby holding the pad 38 against the golfer's buttocks.

As the golfer begins to swing and transitions from his back swing to forward swing, the pad 38 provides a measuring device that enables the golfer to determine if he is maintaining backward pressure against the pad. It is easily detectable by a training advisor, if not the golfer himself, if the golfer should stop exerting a pressure against the pad 38 as a space would develop between the golfer and the pad 38 if he should lean forward beyond the fully expanded length of the compression mechanism 34. It will be appreciated that the pad 38, plate 36, and compression mechanism 34, if provided, form portions of the brace. In addition, as is common in more efficient golf swings, the compression mechanism 34 enables the pad 38 to move backward toward the adjustable shaft 17 as a golfer overcomes the specific amount of force and exerts a higher force against the pad 38. Thus, a golfer is not only able to determine whether or not he maintained contact with the pad 38, but also if he applied the required amount of force against the pad achieved during the highly desirable "sit-down" or "squat."

The compression mechanism 34 may include an adjustable force feature 37, such as an air boss, that enables adjustment of the amount of force required to cause the compression mechanism 34 to compress inward to be adjusted. For example, the compression mechanism 34 may include an air chamber 39, that may be filled to various levels of air pressure to adjust the compressibility of the compression mechanism. Such devices and arrangement therefore are well known in the art. Thus, for a person who is, for example 6'-3", 220 pounds, a specific force may be set in order for the person to cause the compression mechanism 34 to move inwards toward the adjustable shaft 17. But using the adjustable force mechanism, the required force may be lessened if for instance the person is 5'-4" and 140 pounds.

In alternate embodiments, although not shown in the drawings, the compression mechanism 34 may be a foam pad that has a sufficient flexibility and requires a specific force to be applied against it before compressing. By placing this foam pad between the arm 26 and the plate 34, the pad 38 may be caused to move backwards once a force is inwardly applied against the pad that is higher than the specific force required of the foam. Various types of foams, each having differing levels of compressibility, may be substituted depending on the size and weight of the golfer in the particular application. The compression mechanism may also be a simple spring.

In preferred embodiments, the training device 10 may be folded so as to make transport and storage easier. In such instances, it is preferred that the foot plate 12 be hingedly connected to the fixed shaft 14 such that the foot plate may be rotated in an upward direction so as to become substantially parallel with the fixed shaft 14. In addition, the arm 26 may be hingedly connected or removably attached to the adjustable shaft 17. With the arm 26 pivotably attached to the adjustable shaft 17, the arm may be pivoted downward or upward to further compact the training device. This enables a person to easily carry the training device 10 while on the golf course or to and from golf ranges, parks, or anywhere else a golfer may wish to practice their swing. The foot plate may also be provided with wheels, as will be discussed, to assist with transport.

In an alternate embodiment, the fixed shaft 14 and adjustable shaft 17 may be configured as a single shaft. In such case, it is preferred that the single shaft and arm 26 include mechanisms such that the arm height above the foot plate 12 may be adjusted relative to the fixed shaft.

Figure 3:
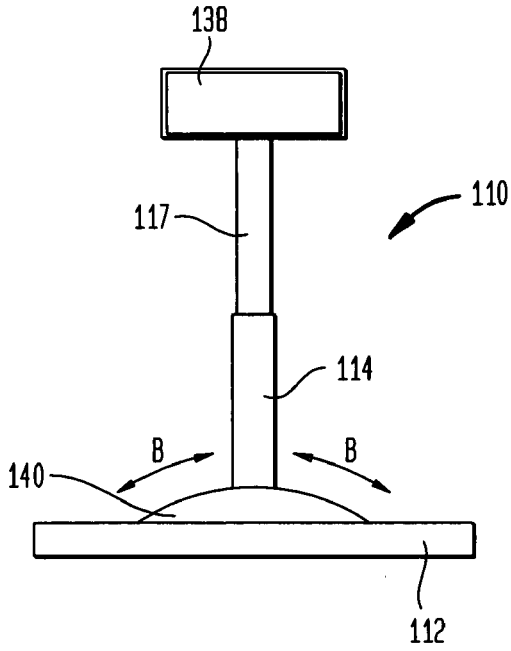
FIG. 3 is a front view of another embodiment of the present invention.

In another alternate embodiment of the present invention shown in FIG. 3, a training device 110 may be similarly constructed to training device 10, but may also include features enabling the fixed shaft 114 to pivot. Thus, as shown in FIG. 3, the training device 110 may include a foot plate 112 pivotally connected to fixed shaft 114 by a pivot mechanism 140. The pivot mechanism 140 enables the fixed shaft 114, as well as the rest of the device (arm, pad, etc.), to rotate clockwise and counterclockwise through an angle 'B,' such that the angle between the fixed shaft 114 and foot plate 112 may be adjusted between a minimum of 0 degrees and a maximum of approximately 90 degrees, as is warranted. By providing the pivoting mechanism 140, should the golfers find themselves on a uphill or downhill position, the fixed shaft 114 may be adjusted relative to the foot plate 112 such that the cushion 138 may be correctly placed against the buttocks of the golfer. This arrangement provides another dimension to the golf training device such that the device may be better adapted for use on sloped surfaces. It will be appreciated that, preferably, the adjustment be conducted to a degree approximately equal to that of the slope hill, such that the user's buttocks remain square with the cushion 138.

In alternate embodiments, the training device 110 may be provided with both a hinge mechanism 16 and a pivot mechanism 140, to provide for greater levels of adjustability, portability, and storage.

Figure 4:
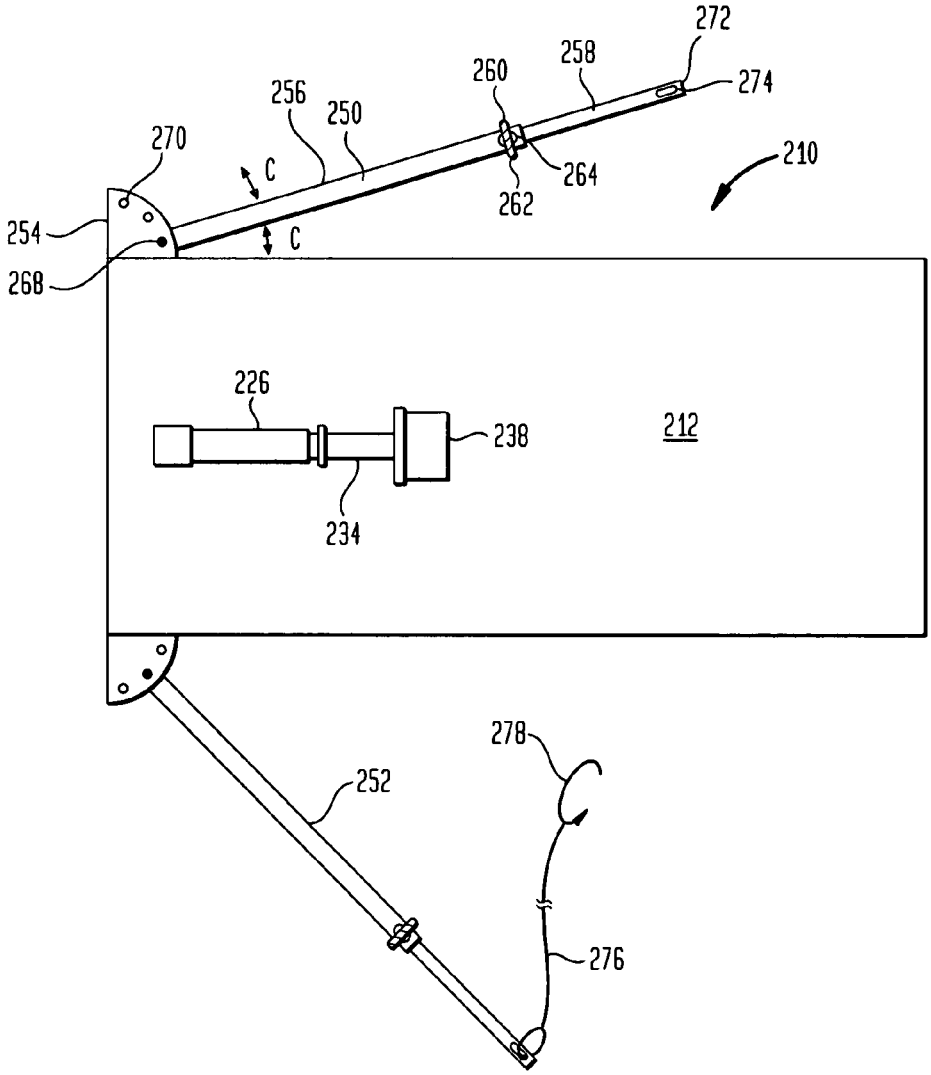
FIG. 4 is a top view of yet another embodiment of the present invention.

In another embodiment shown in FIG. 4, a training device 210 may include mechanisms to address two additional common problems found in golfers, namely "sway" and "slide." References to "sway" and "slide" relate to lateral movement of a golfer during his swing. While the efficient golfer remains relatively motion-free in the lateral directions, a considerable amount of golfers exhibit excessive lateral movement of their hips or pelvis (and possibly knees) during either or both of their backswing and downswing. When excessive movement is in the direction away from the target on the backswing, the condition is referred to as "sway." Alternatively, when the excessive movement is in a direction toward the target on the downswing, the condition is referred to as "slide." Typically, an inefficient golfer will either "sway" back, or "slide" forward, neither of which are preferable.

In order to correct such conditions, it is preferable that the golfer be subject to an external force in the direction of the golfer's condition. For example, a golfer exhibiting excessive "sway" will benefit from an external force pushing or pulling the golfer back, or away from the target, while a golfer exhibiting excessive "slide" will benefit from an external force pushing or pulling the golfer forward, or toward the target. It will be appreciated that such an external force applied in the direction of the excessive movement will cause the golfer to naturally provide an equal and opposite reactive force, to remain upright.

Taking the example of "sway" momentarily, one skilled in the art will note that a force pulling the golfer back, away from the target, during his backswing will force the golfer to stabilize his lower body and rotate, which is against his inefficient tendency to sway. Teaching the golfer to stabilize and rotate his hips as such corrects the natural "sway." The same is true for slide, only utilizing forces in the opposite direction.

A training device provided with mechanisms adapted to impart such forward and backward forces is shown in FIG. 4, as training device 210. Generally, such a device may include features common to the training device 10 of FIG. 1, including a foot plate 212, arm 226, compression mechanism 234, and pad 238. In addition, and to provide assistance with correcting "sway" and "slide" conditions, the training device 210 may also include at least one outrigger, such as the first outrigger 250 and second outrigger 252 shown in FIG. 4.

Taking the first outrigger 250 as an example, each outrigger may be attached to the foot plate 212 by pivot plate 254, the details of which will be discussed below. The outrigger 250 may include a fixed shaft 256 and an adjustable shaft 258. The fixed shaft 256 may be configured such that the adjustable shaft 258 may slide within the fixed shaft to adjust the overall length of the outrigger 250. To temporarily hold the outrigger 250 to the desired length, the outrigger may be configured with a fixation device 260, such as the threaded handle 262 shown in FIG. 4. It will be appreciated that the threaded handle 262 may include an externally threaded shaft that is capable of threaded engagement with an internally threaded aperture 264 formed through the fixed shaft 256, preferably at an end adjacent to the adjustable shaft 258.

In operation, one may at least partially unthread the handle 262 and slide the adjustable shaft 258 to the desired length within the fixed shaft. Once the adjustable shaft 258 is properly adjusted, the handle 262 may be turned to thread the threaded shaft into the internally threaded aperture 264 to abut the threaded shaft against the adjustable shaft, thereby inhibiting movement of the adjustable shaft.

Referring back to the pivot plate 254, it is noted that the outrigger 250 may be adjustable such that it may swing through an arc of rotation 'C.' The adjustment may be achieved through means of a pivot plate 254. As discussed above, the pivot plate may be attached to the foot plate 212. The pivot plate may also include a pin 255 or other fixation device to rotatably affix the fixed shaft 256 of the outrigger 250. By doing so, the fixed shaft 256 of the outrigger 250 may not be removed from the pivot plate 254 (although the fixation device may permit removal) but, the fixed shaft may rotate through the angle 'C.'

The pivot plate 254 may also include adjustment means to hold the outrigger 250 into a chosen angulated position along arc 'C.' Such means may be capable of holding the outrigger in infinitely adjustable positions, such as if the angle plate included a slot and the fixed shaft 256 included a handle with threaded shaft which could be manipulated to thread the threaded shaft against the edges of the slot to prevent further rotation. Such a mechanism could include visual indications of angle degrees such that the position of the outrigger 250 can repeated over the course of multiple training sessions.

In other embodiments, such as the embodiment shown in FIG. 4, the adjustment mechanism may be adjustable only to a limited number of positions. In FIG. 4, there are three such positions. This adjustment capability may be created by rotatably fixing the fixed shaft 256 of the outrigger 250 to the pivot plate 254 with a pin (not shown) as discussed above. In addition, the fixed shaft 256 may be provided with a spring loaded projection 268 while the pivot plate may include apertures 270 which correspond to fit the spring loaded bearing. In this manner, and as commonly known, the outrigger may be rotated to a position where the aperture 270 is just above the spring loaded projection 268, such that the spring loaded projection 268 will fill the aperture to prevent further rotation. To rotate the outrigger 250 again, the spring loaded projection 268 may be manually depressed and the outrigger rotated to the next position.

Using the adjustment means of the outrigger 250 preferably enables a rotation along arc 'C' of between 0 and 90 degrees, although up to 60 degrees is typically sufficient. It will be appreciated that the 0 degree rotation position is typically utilized during transport or storage of the device, or when the particular outrigger is not being utilized. Angles greater than 0 degrees, up to the maximum angle engineered for the particular unit, such as 60 degrees, may be utilized depending on the size of the golfer. For example, a relatively tall golfer with long arms may use a position at approximately 30 degrees while a shorter golfer with a shorter reach may use a 45 degree position. It will also be appreciated that the outriggers themselves may be lengthened or shortened to adjust for the size of the golfer by manipulating the length of the adjustable shaft within the fixed shaft of the given outrigger. By utilizing various combinations of the two adjustments, a wide range of golfer sizes can utilize the same device effectively.

At the far distal end 272 of the outrigger 250, the adjustable shaft 258 may contain an attachment mechanism, such as an aperture 274, for attachment of an elastic cord 276 (shown attached to the second outrigger 252 for clarity). Other attachment mechanisms may include hooks, loops, or the like. It is intended that the elastic cord 276 be sized, both in length and strength, for the specific golfer using the device at any given time. Length adjustment may be provided by well known buckles or other adjustment mechanisms while strength adjustment may be provided by utilizing different diameter elastic cords 276, or multiple elastic cords. In this regard, it will be appreciated that a heavier golfer, or one with a more severe "slide" or "sway," may require a stronger cord than a lighter golfer or one with a less severe "slide" or "sway." Additionally, it will be appreciated that the length of a given cord will also provide a strength adjustment, such that a certain range of strength is possible from a single cord. At the far end of the cord, where the cord attaches to the golfer, the cord may be provided with an attachment mechanism such as a carabineer that may attach to a belt or harness worn by the golfer.

Additional features may also be included in the training device to provide feedback to the user. For example, as shown in FIG. 1, the compression mechanism 34 may include a collar 33 which will indicate the distance that the compression mechanism is compressed during a given golf stroke. In use, the collar 33 may be positioned around the compression mechanism 34, and against the fixed shaft 26. As the compression mechanism 34 is compressed, the collar 33 will remain butted up against the fixed shaft 26 causing the collar to slide along the compression mechanism. Upon rebound of the compression mechanism 34, the collar 33, through an appropriately tight friction fit, will remain in the position to which it is slid farthest. One may then measure that distance and determine how far back the compression mechanism 34 was compressed during a stroke. In an efficient stroke, the golfer will "sit-down" or "squat" slightly. The present invention therefore provides a mechanism to determine this amount, so the golfer can repeat the desired movement.

Figure 5:
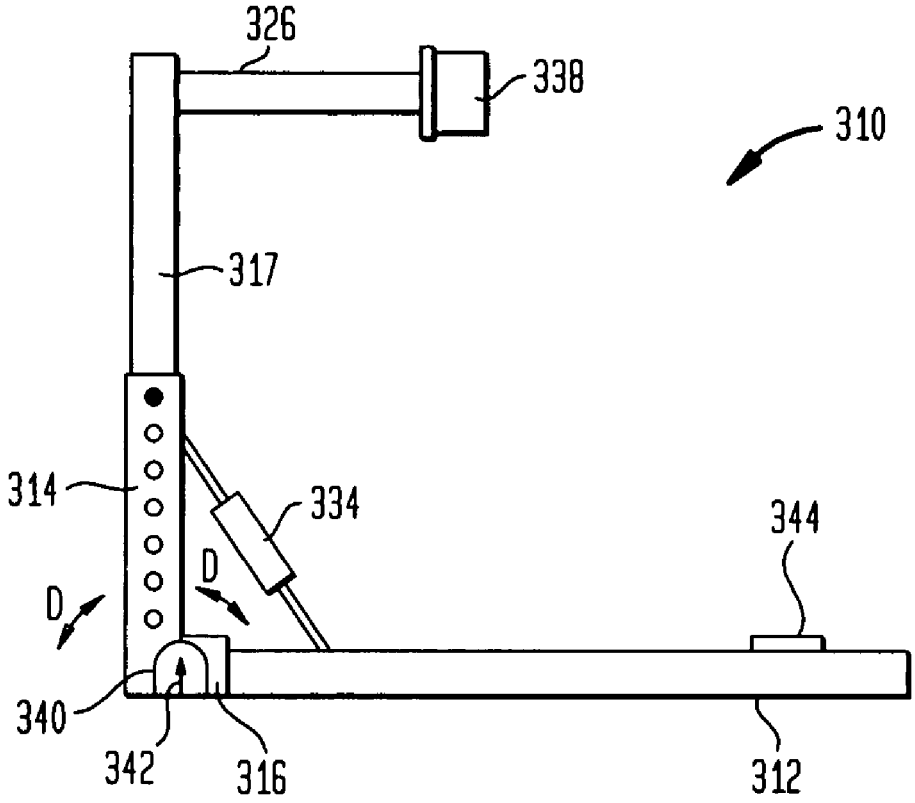
FIG. 5 is a side view of a further embodiment of the present invention.

In other embodiments, such as shown in FIG. 5, a training device 310 may be provided with a tension member 334, rather than a compression member, where the tension member is capable of measuring the amount of "sit-down" or "squat" displayed by the golfer. Such a device may, as in previous embodiments, include a foot plate 312, a fixed shaft 314, an adjustable shaft 317, a fixed arm 326, and a pad 338. In addition, the device may include a hinge 316 connecting the fixed shaft 314 to the foot plate 312. The hinge 316 may be adapted to freely permit the fixed shaft 314 to rotate relative to the foot plate 312 in the directions shown by arrows 'D.' In the meantime, tension mechanism 334, arranged between the fixed shaft 314 and the foot plate 312, restrains such motion, absent the force of a golfer "sitting-down" or "squatting." A dial 340 with indicator arm 342 may be attached to the hinge 316 to indicate the angle of rotation through which the fixed shaft 314 is subjected to during a golfer's swing. Such dials 340 with indicator arms 342 are well known in the industry, and may be provided with an indicator arm that stays at the ultimate excursion limit until moved back manually, or which is fixed to the relative position of the fixed shaft 314.

Alternatively, the hinge 316 may be provided with an inertial sensor, such as a gyroscope or magnetometer in place of the dial 340. Like the dial 340, the inertial sensor may be provided to measure the relative rotation of the fixed shaft 314 against the foot plate 312. If so provided, a digital readout 344 may also be provided. Preferably, the digital readout 344 is positioned on or in the foot plate near the golfer's feet for easy viewing. Like the dial 340, the digital readout 344 may be configured to read the greatest level of excursion, or provide a "real-time" readout, which displays the then current position. In addition to, or in lieu of, a digital readout, a training device may be provided with communication capabilities such as would enable communication with an electronic device, for example a Personal Digital Assistant ("PDA") or computer terminal. For example, the training device 310 shown in FIG. 5 may be provided with Bluetooth, infrared, or other wired or wireless communication capabilities. PDA's or computer terminals may then be configured with data storage and analysis software.

Another option for training devices involves biofeedback sounds. For example, the training device may provide given sound when a golfer performs a task within an acceptable range and another sound when the golfer does not. Other options, which are known in conventional arts, are to provide a sound only when the golfer performs a task outside of the acceptable range or only when a golfer performs a task inside an acceptable range. The sounds may emanate from a sound generation unit 346 built into the training device 310, and in electronic communication with the inertial sensors. In non-powered versions of the device, the sound may be generated by mechanical means, such as a bell (not shown) which may ring if the hinge (e.g., 16, 316) is rotated beyond a certain point. Preferably, any sound inducing mechanism provided will be adjustable such that it may be adjusted for particular use with a given individual.

Figure 6:
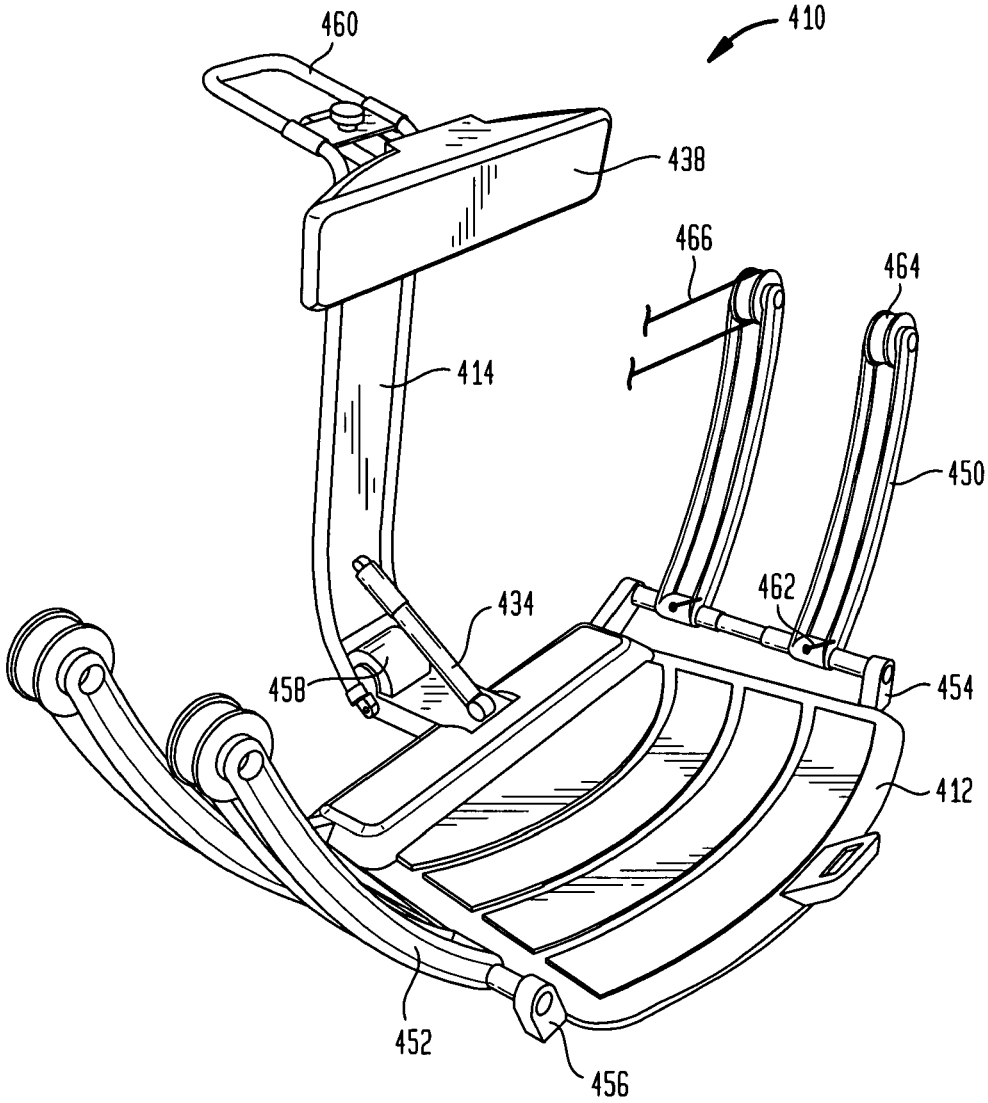
FIG. 6 depicts a perspective view of yet another embodiment of the present invention; and, FIG. 7 depicts an additional embodiment of the present invention.

In another alternate embodiment of the present invention shown in FIG. 6, a training device 410 may be constructed similarly to the training devices 210, 310 previously discussed. In this regard, the training device 410 may include a foot plate 412, an upright support 414 extending from the foot plate, and a brace 438 associated with the upright support. The height of the brace 438 may be manipulated up or down by conventionally known means. The training device 410 may also include a tension mechanism 434 extending between the upright support 414 and the foot plate 412. In lieu of the angled outriggers shown in FIG. 4 in association with training device 210, training device 410 may include outriggers 450, 452 which are aligned in the general direction of the golfer's swing when standing upon the foot plate 412 with his buttocks against the brace 438. In this regard, the outriggers 450, 452 may slide horizontally along the length of their respective support brace 454, 456, and then locked into place using conventional means, such as a locking friction bolt 462. Additionally, the outriggers 450, 452 may also be capable of positioning vertically. This may be achieved on a smooth support brace 454, 456 with the locking friction bolt 462, or may be achieve with a ratcheting mechanism, as is conventionally known.

The outriggers 450, 452 are preferably adapted to support elastic cords, as previously discussed, to assist with correcting "sway" and "slide" conditions. With the four outriggers 450, 452 shown, the teaching capabilities are expanded beyond that which can be achieved with two outriggers. for example, an elastic cord may be attached to the golfer's waist from one outrigger to address a "slide" or "sway" condition, while a second elastic cord my be held in the hands of the golfer to correct other conditions, such as are known in the art. Both elastic cords may originate from the same side of the training device or they can originate from opposite sides, for example from outrigger 452 to the golfer's hip and outrigger 450 to the golfer's hands. This has the added benefit of permitting a cross-pattern, or diagonal type of training effect or option.

In the training device 410 shown in FIG. 6, the outriggers 450, 452 are connected to a support brace 454, 456, rather than directly to the foot plate 412. However, it will be appreciated that in alternate embodiments, the outriggers 450, 452 may be directly connected to the foot plate 412. Finally, the training device 410 may be configured with a wheel 458 and handle 460 to assist with easy transport.

It will also be appreciated that the outriggers 450, 452 of FIG. 6 are shown with pulleys 464 at their ends. If so equipped, the appropriate elastic cord, an example of which is shown as 466, may loop around the pulley 464 of the respective outrigger 450, 452, such that both ends of the cord are attached to the golfer.

Figure 7:
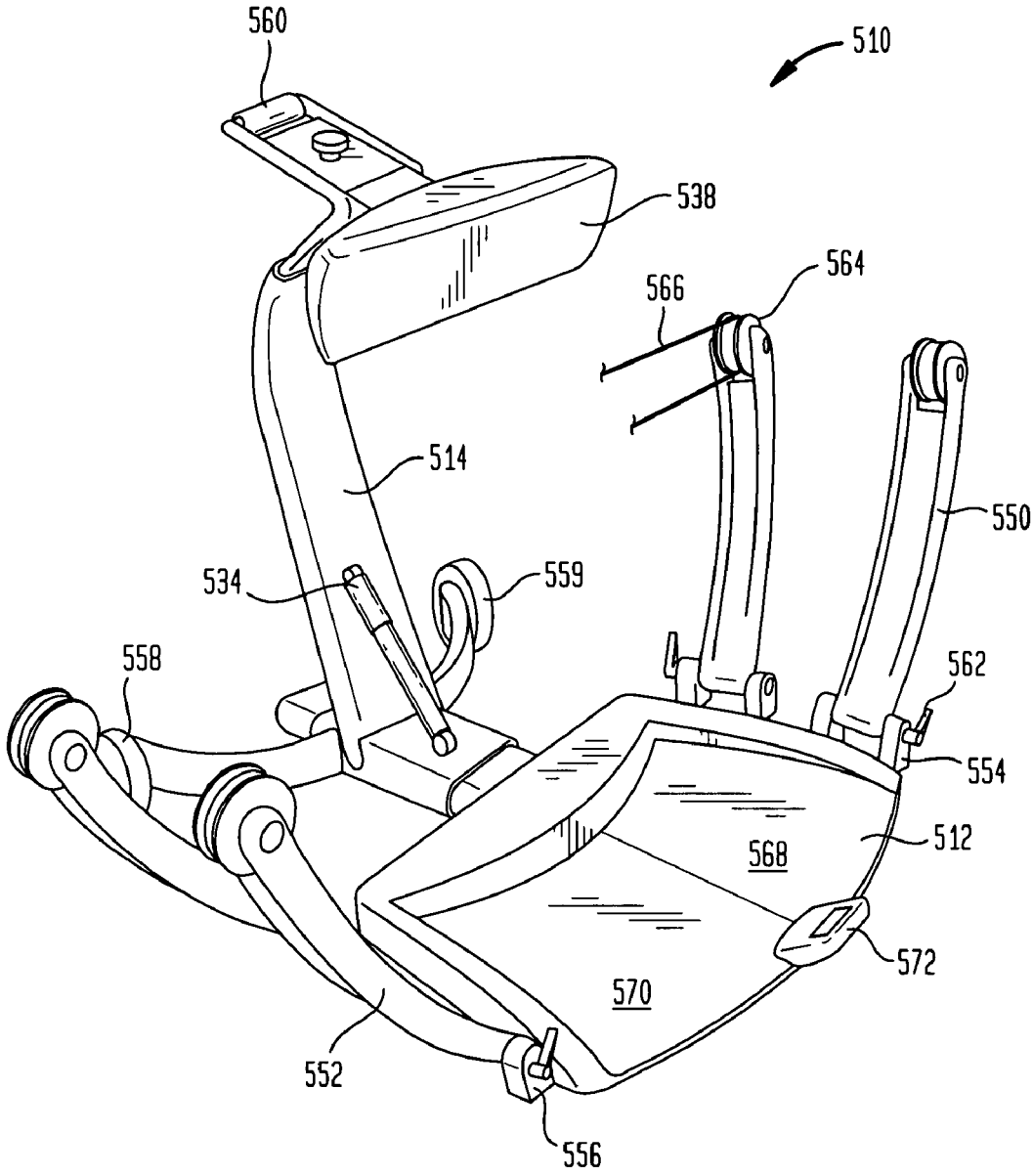

In a still further embodiment of the present invention shown in FIG. 7, a training device 510 may be constructed similarly to the training devices 210, 310, 410 previously discussed. In this regard, the training device 510 may include a foot plate 512, an upright support 514 extending from the foot plate, and a brace 538 associated with the upright support. The height of the brace 538 may be manipulated up or down by conventionally known means. The training device 510 may also include a tension mechanism 534 extending between the upright support 514 and foot plate 512. The training device 510 may also include outriggers 550, 552 which are configured similarly to those shown in FIG. 6 with respect to training device 410. Thus, the outriggers may be aligned in the general direction the golfer's swing when standing upon foot plate 512 with his buttocks against the brace 538. The outriggers 550, 552 also may be adopted to support elastic cords, as previously discussed, to assist with correcting "sway" and "slide" conditions.

In the training device 510 shown in FIG. 7, the outriggers 550, 552 are connected to respective support braces 554, 556 extending from the foot plate 512. Like in other embodiments, the outriggers 510, 512 may connect directly to the foot plate 512. Finally, the training device 510 may be configured with a pair of wheels 558, 559 and the handle 560 to assist with easy transport.

It will also be appreciated that the outriggers 550, 552 of FIG. 7 are shown with pulleys 564 at their ends. If so equipped, the appropriate elastic cord, an example of which is shown as 566, may loop around the pulley 564 of the respective outrigger 550, 552, such that both ends of the cord are attached to the golfer.

Training devices may also be configured with additional features to aid the golfer. For example, the footplate 512 may be split into two regions 568, 570. Each region may be independently situated within the footplate 512 and may be configured with weight detection means, such as known conventionally. The weight detection means may be capable of detecting the weight of a golfer prior to a swing, through the swing process, and finally at the culmination of a swing, to determine at least the force applied into each plate during each such phase of movement. Alternatively, only one of the regions may be configured with weight detection means. In such a configuration, the skilled instructor may calculate the weight of the non-determined region by knowing the golfer's total weight and subtracting that weight measured by the weight detection means. Data compiled by the weight detection means may be displayed on a display unit 572, may be compiled for subsequent examination, and/or may be further manipulated as programmed into electronics of the training device.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

The invention claimed is:

1. A golf training device comprising:

a foot plate;

a shaft extending upward from said foot plate;

an arm extending outward from said shaft to an end, said arm further comprising a compression mechanism adapted to compress and permit said arm end to move toward said shaft upon the occurrence of a sufficient force therein;

wherein a golfer may stand upon said foot plate with his backside against said arm end so as to provide visual and tactical indication of a departure from said arm end during the golfer's swing, said compression mechanism further comprising a measurement device adapted to measure the distance said compression device compresses during the swing of a golfer.

2. The golf training device of claim 1, further comprising a pad situated at said arm end.

3. The golf training device of claim 1, wherein said shaft further includes a fixed shaft and an adjustable shaft, said adjustable shaft adapted to move relative to said fixed shaft to adjust the distance between said arm and said foot plate.

4. The golf training device of claim 1, wherein the force required to compress said compression mechanism is adjustable.

5. The golf training device of claim 1, further comprising a hinge mechanism permitting said shaft to rotate relative to said foot plate.

6. The golf training device of claim 5, further comprising a tension member positioned between said foot plate and said shaft, wherein said tension member restrains rotation of said shaft relative to said foot plate.

7. The golf training device of claim 5, further comprising an angle measuring apparatus adapted to measure the relative angle of said shaft to said foot plate.

8. The golf training device of claim 7, wherein said measuring apparatus further comprises a digital read out.

9. The golf training device of claim 7, wherein said angle measuring apparatus communicates with an electronic device.

10. The golf training device of claim 7, further comprising a sound generating mechanism adapted to communicate a sound in response to angles measured by said angle measuring apparatus.

11. The golf training device of claim 10, wherein said sound is generated by a measurement within a certain range.

12. The golf training device of claim 5, wherein said hinge mechanism enables said shaft to pivot toward said foot plate.

13. The golf training device of claim 1, further comprising a pivot mechanism permitting said shaft to pivot relative to said foot plate.

14. The golf training device of claim 1, further comprising an outrigger attached to said device and an elastic cord attached to said outrigger, wherein said elastic cord may be further attached to a golfer.

15. The golf training device of claim 14, wherein said elastic cord is attached to a golfer on the side of his downswing to correct a slide condition.

16. The golf training device of claim 14, wherein said elastic cord is attached to a golfer on the side of his backswing to correct a sway condition.

17. The golf training device of claim 1, further comprising at least one wheel adapted to permit transport of said training device.

18. The golf training device of claim 1, wherein said foot plate is formed from two regions, at least one of said regions having a weight measurement capability.

* * * * *